US012173719B1

(12) United States Patent
Yao

(10) Patent No.: US 12,173,719 B1
(45) Date of Patent: Dec. 24, 2024

(54) CEILING FAN STRUCTURE

(71) Applicant: Chao Chin Yao, Taichung (TW)

(72) Inventor: Chao Chin Yao, Taichung (TW)

( * ) Notice: Subject to any disclaimer, the term of this patent is extended or adjusted under 35 U.S.C. 154(b) by 0 days.

(21) Appl. No.: 18/435,468

(22) Filed: Feb. 7, 2024

(51) Int. Cl.
*F04D 25/00* (2006.01)
*F04D 25/08* (2006.01)
*F04D 29/34* (2006.01)
*F04D 29/38* (2006.01)

(52) U.S. Cl.
CPC ..... *F04D 25/088* (2013.01); *F04D 29/34* (2013.01); *F04D 29/384* (2013.01)

(58) Field of Classification Search
CPC .... F04D 25/088; F04D 29/384; F04D 19/002; F04D 19/666; F04D 29/668; F04D 29/665
See application file for complete search history.

(56) References Cited

U.S. PATENT DOCUMENTS 680,671 A * 8/1901 Brewster ..... A47J 43/0711 416/227 R
1,868,113 A * 7/1932 Ljungstrom ..... F04D 29/382 415/217.1
6,309,083 B1 * 10/2001 Lathrop ..... F24F 13/078 362/350
8,133,028 B2 * 3/2012 Liu ..... F03D 3/062 416/223 R
9,154,017 B2 * 10/2015 Büttner ..... H02K 7/10
2005/0249598 A1 * 11/2005 Young ..... F04D 19/024 416/198 R
2011/0171021 A1 * 7/2011 VanOtten Tolman ..... F04D 19/024 416/128
2011/0174011 A1 * 7/2011 Kim ..... F24F 1/40 62/426
2012/0222843 A1 * 9/2012 Mitchell ..... F04D 19/007 165/104.34
2016/0097394 A1 * 4/2016 Golm, Jr. ..... F04D 19/007 29/889.3
2019/0024668 A1 * 1/2019 Golm, Jr. ..... F04D 25/0606

* cited by examiner

*Primary Examiner* — Matthew T Largi

(57) ABSTRACT

A ceiling fan structure has a mounting bracket unit, a down rod connected to the mounting bracket unit, a spindle connected below the down rod, a plurality of first fan blades arranged around the spindle and driven to rotate around the spindle, and a plurality of second fan blades. Each first fan blade forms an airflow guide ring. The second fan blade is located in the airflow guide ring. Each first fan blade has a first windward face. Each second fan blade has a second windward face opposite to the first windward face. When the first fan blades are rotated, airflows output by the first windward faces of the first fan blades act on the second windward faces of the second fan blades to push the second fan blades to rotate in a reverse direction relative to the respective first fan blades.

7 Claims, 5 Drawing Sheets

CEILING FAN STRUCTURE

FIELD OF THE INVENTION

The present invention relates to a fan structure, and more particularly, to a ceiling fan structure.

BACKGROUND OF THE INVENTION

In hot weather, if there is no airflow or airflow disturbance, people will feel stuffy and hot and they will use air conditioners, fans and the like to cool off. However, air conditioners are expensive, consume a lot of electricity and have high costs, so ceiling fans with strong wind and a wide range of air supply have become people's first choice for cooling.

In general, the fan blades of conventional ceiling fans are each in the form of an inclined plate. The fan blades are driven to rotate, thereby guiding airflow to blow downward. Because the fan blades are all tilted in the same direction, they guide the air to flow in a single direction. When in use, the fan blades run at a single speed, resulting in a single direction of airflow that cannot be guided to flow in any other direction. The effect of guiding airflow is limited. Accordingly, the inventor of the present invention has devoted himself based on his many years of practical experiences to solve these problems.

SUMMARY OF THE INVENTION

The primary object of the present invention is to provide a ceiling fan structure, comprising first fan blades and second fan blades. The first fan blades and the second fan blades are rotated in opposite directions to form airflow in different directions, thereby improving the effect of guiding airflow.

In order to achieve the foregoing object, the ceiling fan structure provided by the present invention comprises a mounting bracket unit, a down rod, a plurality of first fan blades, and a plurality of second fan blades. The down rod is connected to the mounting bracket unit. A spindle is connected below the down rod. The plurality of first fan blades are disposed around an outer periphery of the spindle and driven to rotate around the spindle. The first fan blades each have a first end portion and a second end portion. The first end portion is connected the spindle through an upper coupling seat, and the second end portion extends downward and is connected to the spindle through a lower coupling seat to form an airflow guide ring. The plurality of second fan blades are pivotally connected to the spindle through a connecting seat. The connecting seat is located between the upper coupling seat and the lower coupling seat. The second fan blades are rotatable relative to the spindle within the respective airflow guide rings of the first fan blades. Each first fan blade has a first windward face that is a face of the first fan blade to output airflow. Each second fan blade has a second windward face opposite to the first windward face. When the first fan blades are rotated, airflows output by the first windward faces of the first fan blades act on the second windward faces of the second fan blades to push the second fan blades to rotate in a reverse direction relative to the respective first fan blades.

Preferably, the first end portion and the second end portion of each first fan blade are tilted in a same direction with a same inclination. The first end portion has a first extension end and a second extension end. The second end portion has a first connecting end and a second connecting end. The first extension end is connected to the second connecting end along an outer edge of the first fan blade, and the second extension end is connected to the first connecting end along an inner edge of the first fan blade to form the airflow guide ring. The airflow guide ring has an airflow guide space therein for a corresponding one of the second fan blades to pass therethrough.

Preferably, the outer periphery of the spindle is sleeved with an upper disk and a lower disk from top to bottom. The first end portion is mounted to the upper disk. The second end portion is mounted to the lower disk. The upper disk is driven to drive the first fan blades and the lower disk to rotate relative to the spindle.

Preferably, a middle disk is provided between the upper disk and the lower disk. The middle disk is pivotally connected to the spindle. The middle disk is rotatable relative to the spindle. Each second fan blade is mounted to the middle disk through the connecting seat and is rotated along with the middle disk.

Preferably, a lighting fixture is provided below the spindle. The lighting fixture is detachably connected to the spindle.

Preferably, the lighting fixture has amounting disk connected to the spindle and a lamp holder connected to the mounting disk through a mounting portion. A plurality of locking posts are provided on an inner peripheral wall of the mounting portion. An outer periphery of the mounting disk are formed with locking grooves corresponding to the locking posts. The locking grooves each have an inlet for a corresponding one of the locking posts to slide therefrom and a guide slope connected to the inlet. The guide slope is inclined and extends from bottom to top. The locking post is slid from the inlet and moved from bottom to top along the guide slope to secure the lamp holder.

Preferably, a restricting recess is disposed between the inlet and the guide slope. A surface of the guide slope, in contact with the locking post, is serrated.

Embodiments of the present invention will now be described, by way of example only, with reference to the accompanying drawings.

DETAILED DESCRIPTION OF THE PREFERRED EMBODIMENTS

Figure 1:
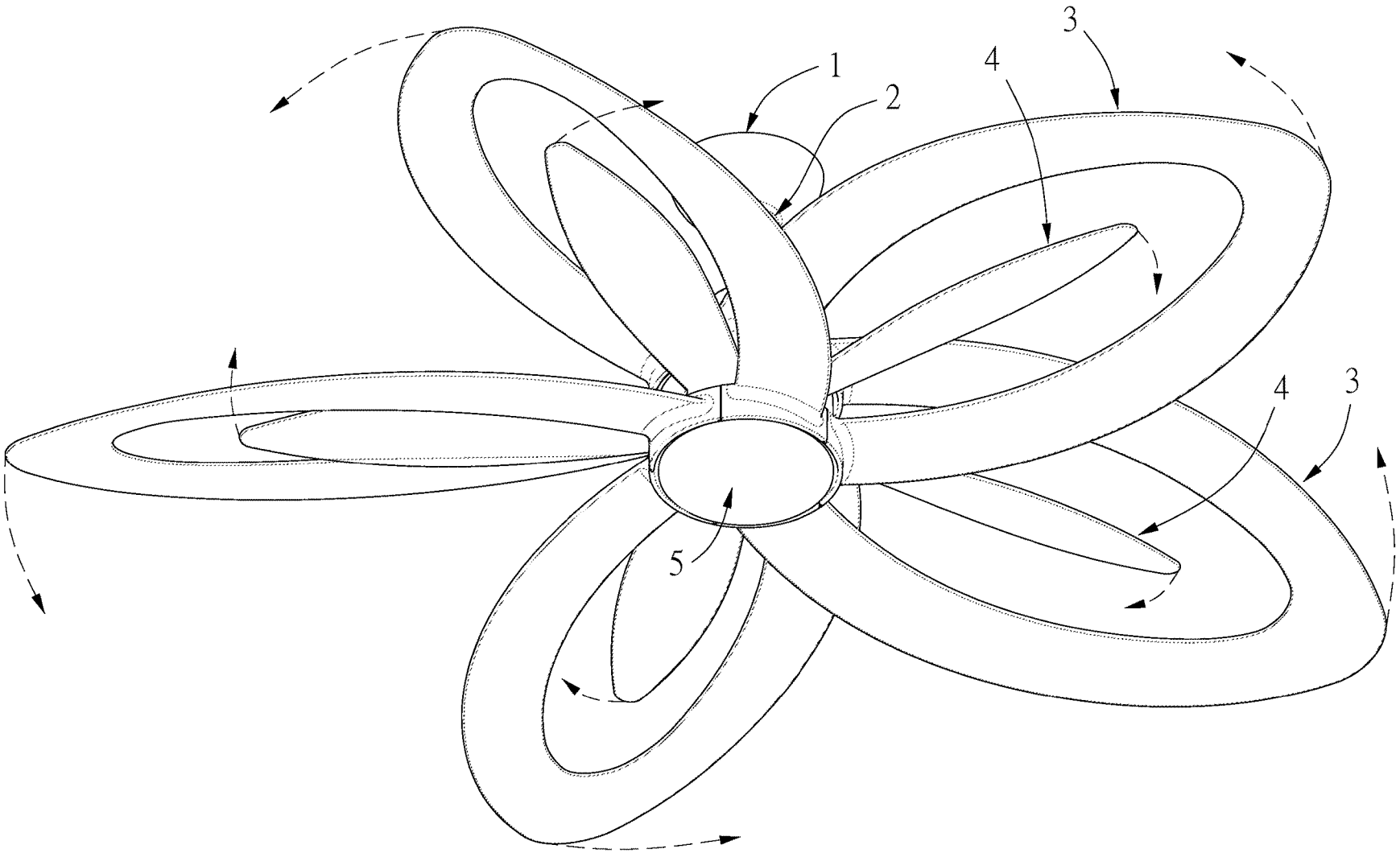
FIG. 1 is a perspective view of the present invention.
Figure 2:
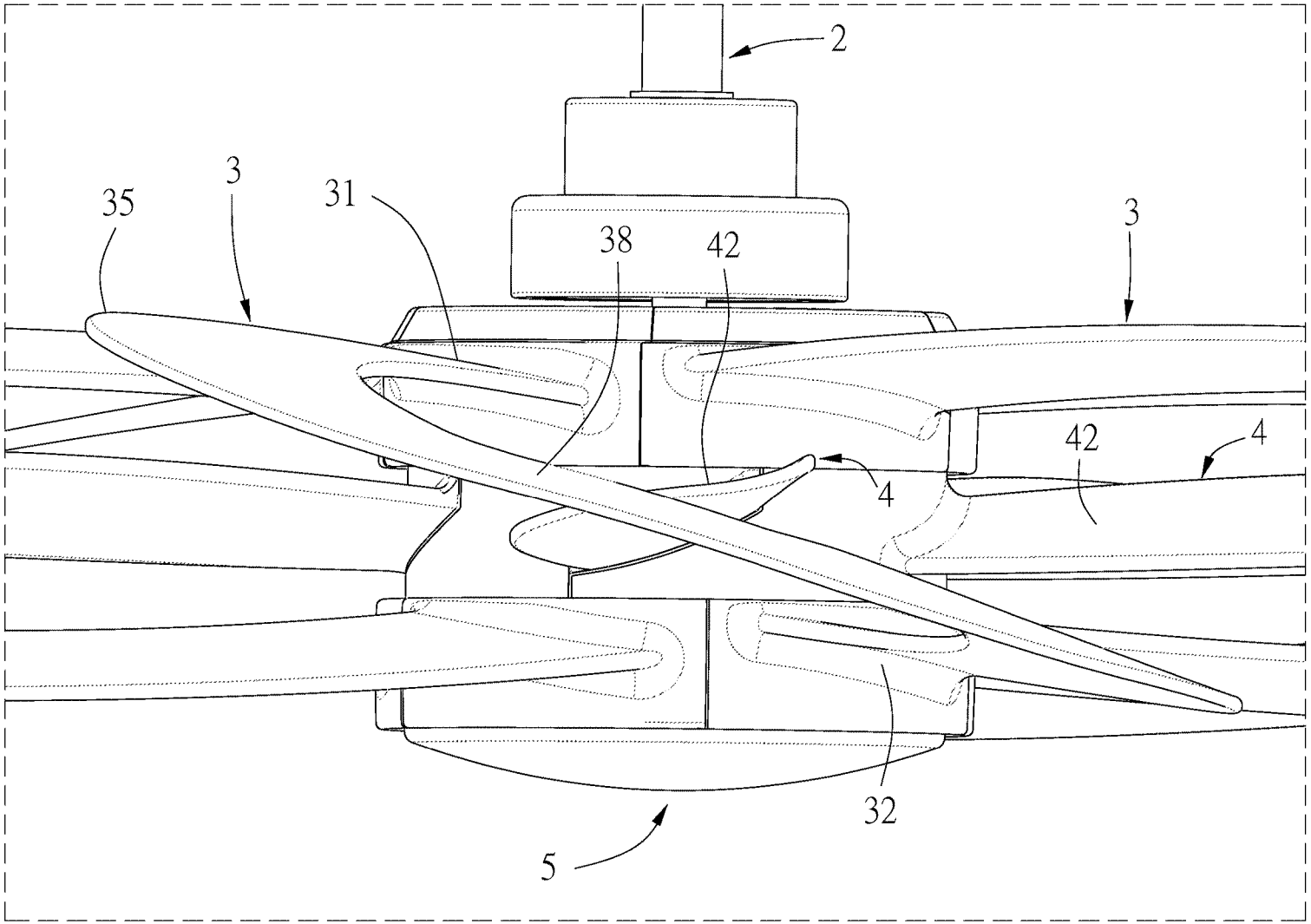
FIG. 2 is a partial, enlarged schematic view of the present invention, illustrating the relative position of the first fan blade and the second fan blade.

As shown in FIG. 1 and FIG. 2, the present invention discloses a ceiling fan structure, comprising a mounting bracket unit 1, a down rod 2, a plurality of first fan blades 3, and a plurality of second fan blades 4.

Figure 3:
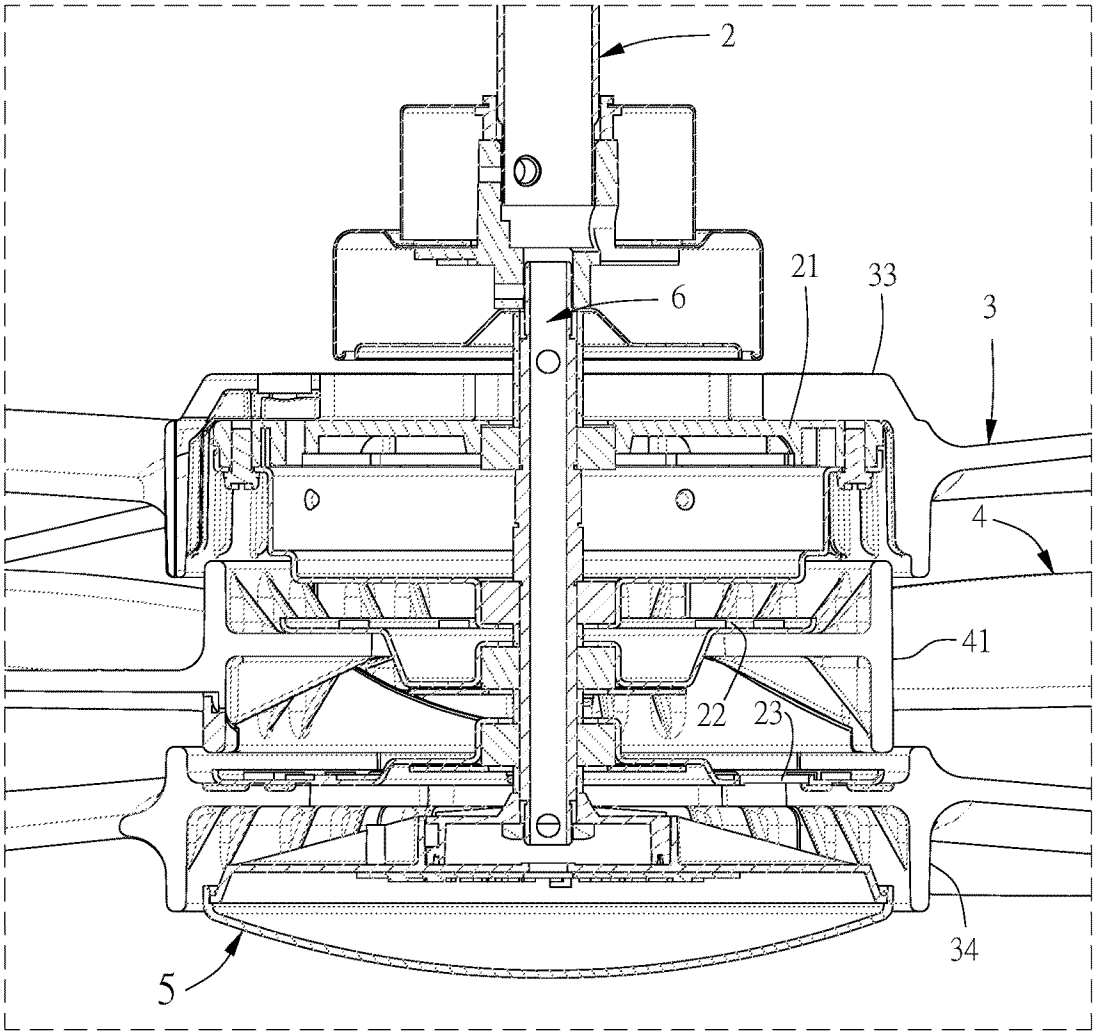
FIG. 3 is a partial cross-sectional view of the present invention.

The mounting bracket unit 1 is configured for mounting the ceiling fan to the ceiling. The down rod 2 is connected to the mounting bracket unit 1. Referring to FIG. 3, a spindle 6 is connected below the down rod 2. The spindle 6 is sleeved with an upper disk 21 and a lower disk 23 from top to bottom. A middle disk 22 is provided between the upper disk 21 and the lower disk 23. The middle disk 22 is pivotally connected to the spindle 6. In this embodiment, the upper disk 21 is driven by an external power source to drive the first fan blades 3 and the lower disk 23 to rotate relative to the spindle 6. As shown in FIG. 1, FIG. 2 and FIG. 3, this embodiment has five first fan blades 3 and five second fan blades 4. Each first fan blade 3 has a first end portion 31 and a second end portion 32. The first end portion 31 is mounted to the upper disk 21 through an upper coupling seat 33, and the second end portion 32 is mounted to the lower disk 23 through a lower coupling seat 34, so that each first fan blade 3 extends from top to bottom to form an airflow guide ring 35. Each second fan blade 4 is mounted to the middle disk 22 through a connecting seat 41 and is rotatable relative to the spindle 6 in the airflow guide ring 35.

Figure 4:
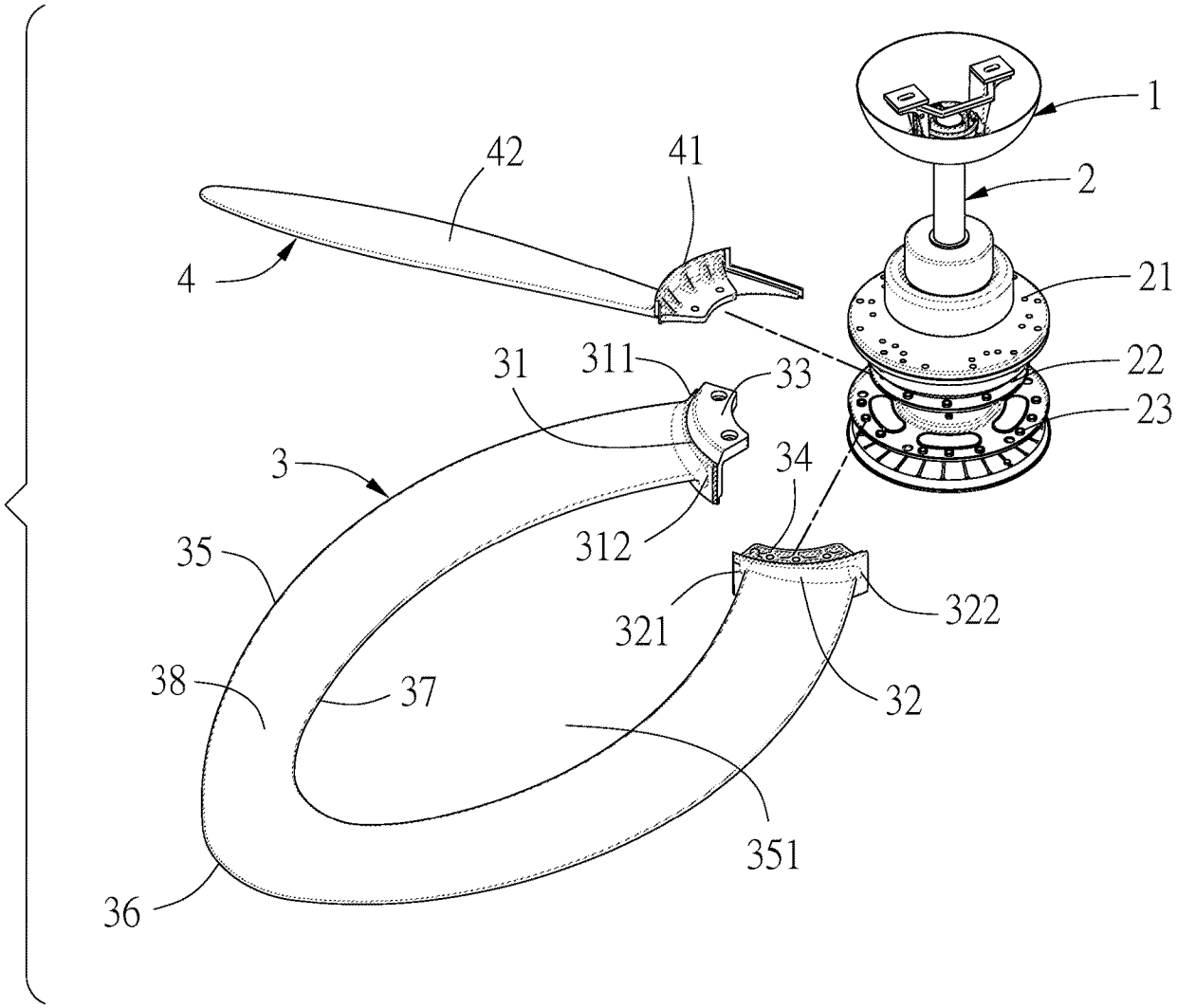
FIG. 4 is a schematic view showing the structure of the first fan blade and the second fan blade of the present invention.
Figure 5:
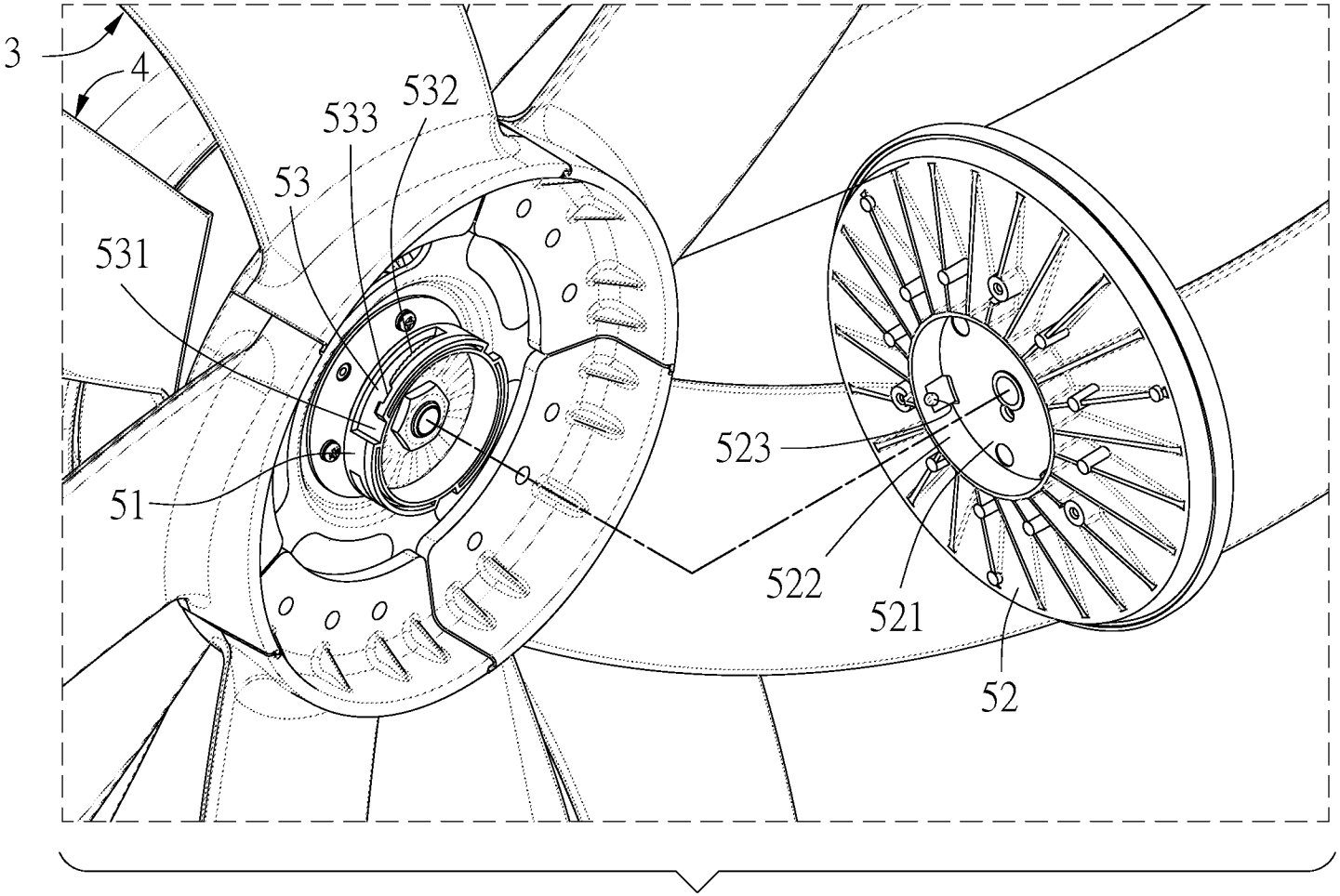
FIG. 5 is a schematic view showing the structure of the lighting fixture of the present invention.

Furthermore, as shown in FIG. 4, the first end portion 31 and the second end portion 32 of the first fan blade 3 are tilted in the same direction with the same inclination. The first end portion 31 has a first extension end 311 and a second extension end 312. The second end portion 32 has a first connecting end 321 and a second connecting end 322. The first extension end 311 is connected to the second connecting end 322 along an outer edge 36, and the second extension end 312 is connected to the first connecting end 321 along an inner edge 37, thereby forming the airflow guide ring 35. The airflow guide ring 35 has an airflow guide space 351 therein for the corresponding second fan blade 4 to pass therethrough. Each first fan blade 3 has a first windward face 38 which is a face of the first fan blade 3 to output airflow. Each second fan blade 4 is tilted in a reverse direction relative to the corresponding first fan blade 3 and has a second windward face 42 opposite to the first windward face 38. As shown in FIG. 1 and FIG. 4, when the upper disk 21 is driven to rotate the respective first fan blades 3 and the lower disk 23, the airflow output from the first windward face 38 acts on the corresponding second windward face 42, so as to drive the respective second fan blades 4 to rotate in the reverse direction relative to the respective first fan blades 3.

When the first fan blades 3 are rotated, because the second fan blades 4 are located in the respective airflow guide spaces 351 of the first fan blades 3, the airflow output by the first windward face 38 acts on the second windward face 42 of the corresponding second fan blade 4. The middle disk 22 connected with the second fan blades 4 is pivotally connected to the spindle 6. Therefore, the second fan blades 4 are driven by the airflow and rotated in the reverse direction relative to the respective first fan blades 3. During operation, there is a rotational speed difference between the first fan blades 3 and the second fan blades 4. When the relative positions of the first fan blades 3 and the second fan blades 4 are overlapped or staggered, different speeds and directions of airflow are formed to expand the range of airflow. The intensity and frequency of wind changes are closer to the natural wind, which makes the human body feel more comfortable and improves indoor air circulation.

Generally, ceiling fans do not have a lighting function. The fan blades of ceiling fans are prone to block the light from the lighting lamp. In order to further improve the functionality of the present invention, a lighting fixture 5 is provided below the spindle 6. The lighting fixture 5 is detachably connected to the spindle 6. The present invention is able to keep cool and provide illumination and prevent the fan blades from blocking the light.

The lighting fixture 5 has a mounting disk 51 connected to the spindle 6 and a lamp holder 52 connected to the mounting disk 51 through a mounting portion 521. A plurality of locking posts 523 are provided on an inner peripheral wall 522 of the mounting portion 521. In this embodiment, there are three locking posts 523 on the inner peripheral wall 522 of the mounting portion 521. The outer periphery of the mounting disk 51 are formed with locking grooves 53 corresponding to the locking posts 523. The locking grooves 53 each have an inlet 531 for the corresponding post 523 to slide therefrom and a guide slope 532 connected to the inlet 531. The guide slope 532 is inclined and extends from bottom to top. The present invention further includes a restricting recess 533 between the inlet 531 and the guide slope 532, which facilitates the initial restriction during installation to prevent the lamp holder 52 from slipping off. The surface of the guide slope 532, in contact with the locking post 523, is serrated to increase the friction between the guide slope 532 and the locking post 523, so as to ensure stable installation of the lamp holder 52.

When in use, the locking post 523 is slid from the inlet 531 into the restricting recess 533 and then moved from bottom to top along the guide slope 532 to secure the lamp holder 52. When the lamp holder 52 is to be disassembled, the lamp holder 52 is rotated in the reverse direction for the locking post 523 to slide from top to bottom along the guide slope 532 to the restricting recess 533. Then, the lamp holder 52 is slightly pushed upward, allowing the locking post 523 to move out of the restricting recess 533, such that the lamp holder 52 can be removed. The detachable lamp holder 52 facilitates replacement and maintenance.

The ceiling fan structure provided by the present invention is able to blow airflow of different speeds and directions, caused by the difference in rotational speeds between the first fan blades and the second fan blades, so as to generate airflow in different directions. The intensity and frequency of wind changes are closer to the natural wind, which makes the human body feel more comfortable and improves indoor air circulation. The detachable lighting fixture facilitates replacement and maintenance, having better practicality.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan structure, comprising:

a mounting bracket unit, a down rod, connected to the mounting bracket unit, a spindle being connected below the down rod;

a plurality of first fan blades, disposed around an outer periphery of the spindle and driven to rotate around the spindle, the plurality of first fan blades each having a first end portion and a second end portion, the first end portion being connected the spindle through an upper coupling seat and the second end portion extending downward and being connected to the spindle through a lower coupling seat to form an airflow guide ring;

a plurality of second fan blades, pivotally connected to the spindle through a connecting seat, the connecting seat being located between the upper coupling seat and the lower coupling seat, the plurality of second fan blades being rotatable relative to the spindle within the respective airflow guide rings of the plurality of first fan blades;

wherein each first fan blade has a first windward face that is a face of each first fan blade to output airflow, each second fan blade has a second windward face opposite to the first windward face, when the plurality of first fan blades are rotated, airflows output by the first windward faces of each of the plurality of first fan blades act on the second windward faces of each of the plurality of second fan blades to push the plurality of second fan blades to rotate in a reverse direction relative to the plurality of first fan blades.

2. The ceiling fan structure as claimed in claim 1, wherein the first end portion and the second end portion of each first fan blade are tilted in a same direction with a same inclination, the first end portion has a first extension end and a second extension end, the second end portion has a first connecting end and a second connecting end, the first extension end is connected to the second connecting end along an outer edge of each first fan blade and the second extension end is connected to the first connecting end along an inner edge of each first fan blade to form the airflow guide ring, and the airflow guide ring has an airflow guide space therein for a corresponding one of the plurality of second fan blades to pass therethrough.

3. The ceiling fan structure as claimed in claim 1, wherein the outer periphery of the spindle is sleeved with an upper disk and a lower disk from top to bottom, the first end portion is mounted to the upper disk, the second end portion is mounted to the lower disk, and the upper disk is driven to drive the plurality of first fan blades and the lower disk to rotate relative to the spindle.

4. The ceiling fan structure as claimed in claim 3, wherein a middle disk is provided between the upper disk and the lower disk, the middle disk is pivotally connected to the spindle, the middle disk is rotatable relative to the spindle, and each second fan blade is mounted to the middle disk through the connecting seat and is rotated along with the middle disk.

5. The ceiling fan structure as claimed in claim 1, wherein a lighting fixture is provided below the spindle, and the lighting fixture is detachably connected to the spindle.

6. The ceiling fan structure as claimed in claim 5, wherein the lighting fixture has a mounting disk connected to the spindle and a lamp holder connected to the mounting disk through a mounting portion, a plurality of locking posts are provided on an inner peripheral wall of the mounting portion, an outer periphery of the mounting disk are formed with locking grooves corresponding to the locking posts, the locking grooves each have an inlet for a corresponding one of the locking posts to slide therefrom and a guide slope connected to the inlet, the guide slope is inclined and extends from bottom to top, and the locking post is slid from the inlet and moved from bottom to top along the guide slope to secure the lamp holder.

7. The ceiling fan structure as claimed in claim 6, wherein a restricting recess is disposed between the inlet and the guide slope, and a surface of the guide slope, in contact with the locking post, is serrated.

* * * * *